US007823635B2

(12) United States Patent
Wright et al.

(10) Patent No.: US 7,823,635 B2
(45) Date of Patent: Nov. 2, 2010

(54) DOWNHOLE OIL AND WATER SEPARATOR AND METHOD

(75) Inventors: Adam Davis Wright, Dallas, TX (US); Roger Lynn Schultz, Aubrey, TX (US); Syed Hamid, Dallas, TX (US); Harry D. Smith, Jr., Montgomery, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 225 days.

(21) Appl. No.: 10/924,161

(22) Filed: Aug. 23, 2004

(65) Prior Publication Data

US 2006/0037746 A1 Feb. 23, 2006

(51) Int. Cl.
*E21B 43/34* (2006.01)
*E21B 43/38* (2006.01)

(52) U.S. Cl. ..... 166/105.5; 166/228

(58) Field of Classification Search ..... 166/249, 166/268, 228, 365, 105.5
See application file for complete search history.

(56) References Cited

U.S. PATENT DOCUMENTS 4,241,787 A 12/1980 Price
4,296,810 A 10/1981 Price
4,738,779 A * 4/1988 Carroll et al. ..... 210/512.2
5,127,457 A 7/1992 Stewart et al.
5,149,432 A 9/1992 Lavin
5,156,586 A 10/1992 Fitch, Jr. et al.
5,195,939 A 3/1993 Gingras
5,240,073 A 8/1993 Bustamante et al.
5,296,153 A 3/1994 Peachey
5,370,000 A 12/1994 Herwig et al.
5,370,600 A 12/1994 Fitch, Jr. et al.
5,389,128 A 2/1995 Lopes
5,425,416 A 6/1995 Hammeke et al.
5,431,228 A 7/1995 Weingarten et al.
5,443,120 A 8/1995 Howell
5,456,837 A 10/1995 Peachey
5,462,116 A * 10/1995 Carroll ..... 166/249
5,484,383 A 1/1996 Fitch, Jr. et al.
5,565,078 A 10/1996 Sams et al.
5,570,744 A 11/1996 Weingarten et al.
5,730,871 A 3/1998 Kennedy et al.
5,819,955 A * 10/1998 Clarke ..... 209/732

(Continued)

FOREIGN PATENT DOCUMENTS

EP 0834342 B1 2/2003

(Continued)

OTHER PUBLICATIONS

Lahann, Joerg, "A Reversibly Switching Surface," *Science Magazine*, vol. 299, pp. 371-374, Jan. 17, 2003.

(Continued)

*Primary Examiner*—David J Bagnell
*Assistant Examiner*—Brad Harcourt
(74) *Attorney, Agent, or Firm*—Joshua A. Griswold

(57) ABSTRACT

A downhole oil and water separator for an oil well includes a water-selective membrane disposed in a production flowpath of the well. The water-selective membrane is operable to selectively pass water from the production flowpath to a disposal zone to increase the concentration of oil in the production flowpath at the surface.

30 Claims, 6 Drawing Sheets

U.S. PATENT DOCUMENTS

| | | | | |
|---|---|---|---|---|
| 5,857,519 | A | 1/1999 | Bowlin et al. | |
| 5,899,270 | A | 5/1999 | Watson | |
| 5,916,082 | A | 6/1999 | Opfer | |
| 5,961,841 | A | 10/1999 | Bowers | |
| 5,988,275 | A | 11/1999 | Brady et al. | |
| 5,992,521 | A | 11/1999 | Bergren et al. | |
| 5,996,690 | A | 12/1999 | Shaw et al. | |
| 6,015,011 | A | 1/2000 | Hunter | |
| 6,017,456 | A | 1/2000 | Kennedy et al. | |
| 6,033,567 | A | 3/2000 | Lee et al. | |
| 6,056,054 | A | 5/2000 | Brady et al. | |
| 6,068,053 | A | 5/2000 | Shaw | |
| 6,080,312 | A | 6/2000 | Bowers et al. | |
| 6,082,452 | A * | 7/2000 | Shaw et al. | 166/105.5 |
| 6,089,317 | A | 7/2000 | Shaw | |
| 6,119,870 | A | 9/2000 | Maciejewski et al. | |
| 6,131,655 | A | 10/2000 | Shaw | |
| 6,138,757 | A | 10/2000 | Latos et al. | |
| 6,138,758 | A | 10/2000 | Shaw et al. | |
| 6,142,224 | A | 11/2000 | Stuebinger et al. | |
| 6,152,218 | A | 11/2000 | Safargar | |
| 6,173,768 | B1 | 1/2001 | Watson | |
| 6,173,774 | B1 | 1/2001 | Fox | |
| 6,189,613 | B1 | 2/2001 | Chachula et al. | |
| 6,196,312 | B1 | 3/2001 | Collins et al. | |
| 6,196,313 | B1 | 3/2001 | Simons | |
| 6,202,744 | B1 | 3/2001 | Shaw | |
| 6,209,641 | B1 | 4/2001 | Stevenson | |
| 6,234,258 | B1 | 5/2001 | Karigan | |
| 6,260,619 | B1 | 7/2001 | Svedeman et al. | |
| 6,328,118 | B1 | 12/2001 | Karigan | |
| 6,336,503 | B1 | 1/2002 | Alhanati et al. | |
| 6,336,504 | B1 | 1/2002 | Alhanati et al. | |
| 6,357,530 | B1 | 3/2002 | Kennedy et al. | |
| 6,367,547 | B1 | 4/2002 | Towers et al. | |
| 6,382,316 | B1 | 5/2002 | Kintzele | |
| 6,436,298 | B1 | 8/2002 | Parkinson | |
| 6,494,258 | B1 | 12/2002 | Weingarten | |
| 6,543,537 | B1 | 4/2003 | Kjos | |
| 6,547,003 | B1 | 4/2003 | Bangash et al. | |
| 6,550,535 | B1 | 4/2003 | Traylor | |
| 6,554,068 | B1 | 4/2003 | Chatterji et al. | |
| 6,627,081 | B1 | 9/2003 | Hilditch et al. | |
| 6,672,385 | B2 | 1/2004 | Kilaas et al. | |
| 6,691,781 | B2 | 2/2004 | Grant et al. | |
| 6,705,402 | B2 | 3/2004 | Proctor | |
| 6,719,048 | B1 | 4/2004 | Ramos et al. | |
| 6,736,880 | B2 | 5/2004 | Ford et al. | |
| 6,755,250 | B2 | 6/2004 | Hall et al. | |
| 6,755,251 | B2 | 6/2004 | Thomas et al. | |
| 6,755,978 | B2 | 6/2004 | Oddie | |
| 6,761,215 | B2 | 7/2004 | Morrison et al. | |
| 6,868,907 | B2 | 3/2005 | Homstvedt et al. | |
| 6,868,911 | B1 | 3/2005 | Jacobson et al. | |
| 2002/0084073 | A1 | 7/2002 | Underdown et al. | |
| 2002/0189807 | A1 * | 12/2002 | Emanuele et al. | 166/266 |
| 2003/0051874 | A1 | 3/2003 | Munson et al. | |
| 2003/0079876 | A1 | 5/2003 | Underdown | |
| 2003/0141057 | A1 | 7/2003 | Homstvedt et al. | |
| 2003/0145991 | A1 | 8/2003 | Olsen | |
| 2004/0069494 | A1 | 4/2004 | Olsen et al. | |
| 2004/0074390 | A1 | 4/2004 | Ford et al. | |
| 2004/0104027 | A1 | 6/2004 | Rossi et al. | |
| 2004/0112602 | A1 | 6/2004 | Arebrat | |
| 2004/0134654 | A1 | 7/2004 | Snow | |

FOREIGN PATENT DOCUMENTS

| | | | |
|---|---|---|---|
| GB | 2 395 504 | | 5/2004 |
| WO | WO 92/00810 | | 1/1992 |
| WO | WO 9603566 | A2 | 2/1996 |
| WO | WO 9725150 | A1 | 7/1997 |
| WO | WO 9837307 | A1 | 8/1998 |
| WO | WO 9841304 | | 9/1998 |
| WO | WO 0065197 | A1 | 11/2000 |
| WO | WO 0123707 | A1 | 4/2001 |
| WO | WO 0131328 | A1 | 5/2001 |
| WO | WO 0214647 | A1 | 2/2002 |
| WO | WO 03/022409 | A1 | 3/2003 |
| WO | WO 03062597 | A1 | 7/2003 |
| WO | WO 2004/053291 | A1 | 6/2004 |

OTHER PUBLICATIONS

MIT News, "*MIT's Smart Surface Reverse Properties*," Jan. 16, 2003 <http://web.mit.edu/newsoffice/nr/2003/smartsurface.html>, visited Dec. 3, 2003.

"Chemists Concoct Quick-Change Surface," *Science*, vol. 299, Jan. 17, 2003, pp. 321 and 323.

Huber, Dale L. et al, "Programmed Adsorption and Release of Proteins in a Microfluidic Device," *Science*, vol. 301, Jul. 18, 2003, pp. 352-354.

U.S. Appl. No. 10/883,368 titled, "*Fluid Separator with Smart Surface*,"1 page Cover, 30 pages specification, claims and abstract and 11 pages of drawings, filed Jul. 1, 2004.

C. C. Jensen A/S, Lovholmen 13, 5700 Svendborg, Denmark, "CJC™ Filter Separators," 2 pages <http://www.cjc.dk/index.php?m=p&pid=34>, visited Sep. 27, 2004.

Aker Kvaerner, Top Separator, 1 page <http://www.akerkvaerner.com/Internet/IndustriesAndServices/Pulping/Fiberlinerecaust/Co>, visited Sep. 13, 2004.

Aker Kvaerner, "Kvaerner Process Systems—Process Systems and Complete Process Trains For The Oil and Gas Industry," 3 pages <http://www.offshore-technology.com/contractors/separation/kvaerner3/>, visited Sep. 13, 2004.

Looksmart, "Downhole Separation Eliminates Premature Oil Well Shut-Ins," *World Oil*, Apr. 1998, 3 pages http://www.findarticles.com/p/articles/mi__m3159/is__n4__219/ai__20872448, visited Sep. 13, 2004.

Gibbs, Walter, "A Cleaner, Brighter Oil Age," May 2, 2002, 5 pages http://www.nortrade.com/OilGas/Articles/ShowArticle.aspx?id=27&sectorid=25>, visited Sep. 13, 2004.

Nilsen, Pâet al, "A Novel Separator Inlet Design," 1999, 1 pg. http://www01.se.abb.com/global/gad/gad00393.nsf/0/8a9875a54720ef79c1256ccc0048747>, site visited Sep. 13, 2004.

Stewart Technology Associates, *Overview of STA, "Recent Installations—Zetapdm," 3 pages <http://www.stewart-usa.com/id73*_m.htm>, visited Sep. 13, 2004.

Hart's E&Pnet, "March: Subsea Processing: Seabed Processing Comes of Age," Mar. 2000, 5 pages, <http://www.eandpnet.com/ep/previous/0300/seabed.htm>, visited Sep. 13, 2004.

Technology Applications, Mar. 2000, 2 pgs.

Jotne Link, "Separators From Jotne to Grane", 2000, 1 pg. http://www.jotne.com/jotnelink/sept00/separators.html>, visited Sep. 13, 2004.

Affleck, Richard Peter, "Recovery of Xylitol From Fermentation of Model Hemicellulose Hydrolysates Using Membrane Technology," Dec. 12, 2000, Blacksburg, Virginia, 118 pgs.

Eurolakes, *Integrated Water Resource Management for Important Deep European Lakes and Their Catchment Areas*, "D-15: Technical Considerations part 3—EUROSKIM," Feb. 25, 2002, 59 pgs.

NCSRT, "OPTI*SEP* 200 & 400 Biopharmaceutical Processing, Flat Sheet Membrane Holder," 2 pages <http://www.ncsrt.com/web_development/web_site/filt_optisep.htm,>, site visited Sep. 13, 2004.

LeCoffre, Yves, et al, "Optisep ®, A new concept in liquid-liquid separation," Force Downhole Subsea Processing Seminar, Mar. 16-17, 1999, Stavanger, YLec Consultants, 19 pgs.

Dougherty, Cynthia C., Memorandum to Water Management Division Directors EPA Regions I-X, Well Classification Guidance for Downhole Hydrocarbon/Water Separators, UIC Program Guidance =82, Jan. 5, 2000, 8 pgs.

Kvaerner, KOP Internet, materials from Website, 4 pages <http://www.kop.kvaerner.com>, visited Mar. 22, 2002.

Wolff, Erik A., et al., "Advanced Electrostatic Internals in the 1st Stage Separator Enhance Oil/Water Separation and Reduce Chemical Consumption on the Troll C Platform," OTC 16321, *Offshore Technology Conference*, Houston, Texas, May 3-6, 2004, pp. 1-7.

"Quantum Leap in Downhole Separation," PetroMin, Mar. 2000, pp. 28-31.

Gunnerod, Terje, "Quantum Leap in Downhole Separation," prior to Mar. 2000, pp. 7-10.

Verbeek, P.H.J., et al., "Downhole Separator Produces Less Water and More Oil," SPE 50617, Society of Petroleum Engineers, Inc., Copyright 1998, pp. 429-434.

"Downhole Separator Produces Less Water and More Oil," JPT, Mar. 1999, 2 pages.

Schanke, T., et al., "Oil in Water Monitoring for Subsea and Downhole Separators," SPE 66538, Society of Petroleum Engineers, Inc., copyright 2001, pp. 1-6.

U.S. Appl. No. 10/692,564 titled, "Orbital Downhole Separator," 29 pages specification, claims and abstract and 6 pages of drawings, filed Oct. 24, 2003.

* cited by examiner

DOWNHOLE OIL AND WATER SEPARATOR AND METHOD

TECHNICAL FIELD

Oil well production, and more particularly to a downhole oil and water separator and method.

BACKGROUND

In oil well production operations, relatively large quantities of water are frequently produced along with the oil. In some oil wells, water and other by-products can amount to as much as eighty to ninety percent of the total production yield. This is particularly true during the later stages of production.

Various methods have been employed for separating the oil from the water. For example, oil and water are typically pumped or otherwise flowed together to the surface where they are treated to separate the oil from the water. The water, after having been pumped to the well surface and separated, is disposed of by removal from the site or by pumping back into the well for injection into a disposal layer.

Downhole separation has also been used to separate the oil and water produced by a well. For example, hydroclones, dynamic mechanical systems that use centralized forces to separate fluids, and combinations of mechanical pumps and gravity separation have been used for achieving separation of production fluids into water and oil components. Hydrophilic and other semi-permeable membranes have been used in connection with submersible pumps for downhole separation.

SUMMARY

Oil and water are separated downhole using a water-selective membrane. The separated water may be disposed of downhole and the oil produced to the surface.

In a particular embodiment, the downhole oil and water separator includes a plurality of perforated collector tubes disposed laterally in the production flow path. In this embodiment, the collector tubes may overlap or criss-cross to form a serpentine or other high contact area flowpath. In another embodiment, the water-selective membrane may be included in a filter element disposed in the production flowpath at the level of the disposal zone. In these and/or other embodiments, the production flowpath may be filtered without downhole mechanical pumping.

Technical advantages of one or more embodiments of the downhole oil and water separator and method include providing an improved method and system for separating oil and water downhole within a wellbore. For example, water may be separated from the oil in the production flowpath and injected into a disposal zone without use of mechanical pumping. In particular, water may be removed from the production flowpath through the water-selective membrane at the level of or otherwise in communication with a disposal zone. Accordingly, equipment and production costs are reduced.

Another technical advantage of one or more embodiments of the downhole oil and water separator includes providing a water-selective filter with increased efficacy. In particular, the separator may include a plurality of perforated collector tubes disposed laterally in the production flowpath or otherwise to form a serpentine flowpath or otherwise increase surface contact area of the filter for increased water removal. Accordingly, the concentration of water in the produced fluids at the surface is reduced.

These technical advantages may be present in none, some or all embodiments of the downhole oil and water separator and method. In addition, other technical advantages will be readily apparent based on the following figures, description and claims.

DESCRIPTION OF DRAWINGS

Like reference symbols in the various drawings indicate like elements.

DETAILED DESCRIPTION

Figure 1:
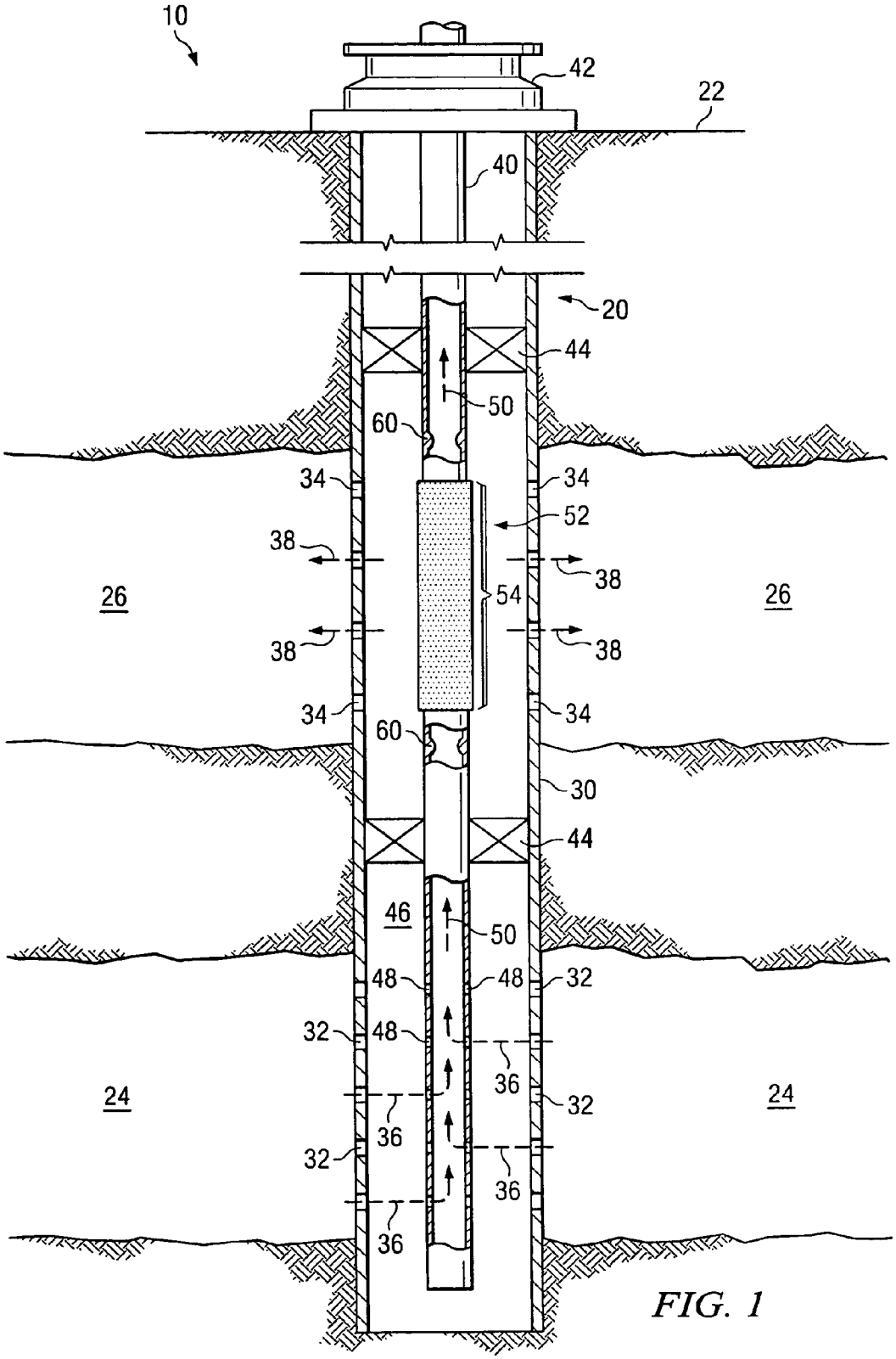
FIG. 1 illustrates one embodiment of an oil well with a downhole oil and water separator.

FIG. 1 illustrates one embodiment of a producing oil well 10. As used herein, oil well 10 includes any well producing or operable to produce hydrocarbons from one or more subsurface formations. The oil well 10 includes a wellbore 20 extending from the surface 22 to a production zone 24. The production zone 24 produces oil and associated by-products including water. A disposal zone 26 for water and/or other by-products may be disposed between the surface 22 and the production zone 24. In another embodiment, the disposal zone 26 may be disposed below production zone 24. In yet another embodiment, the disposal zone 26 may comprise a portion of the production zone 24. Thus, the production and disposal zones 24 and 26 may be disparate formations separated by intermediate formations or may comprise disparate areas of a common formation.

Wellbore 20 is cased with casing 30 which may be cemented in place at the bottom of wellbore 20. Perforations 32 may be formed in the casing 30 at the level of production zone 24. Similarly, perforations 34 may be formed in the casing 30 at the level of the disposal zone 26. The perforations 32 in the production zone 24 allow formation fluids 36 including oil and water to enter into the interior of the casing 30 for treatment and production. Perforations 34 in the disposal zone permit water 38 separated from the formation fluid 36 to be discharged, disposed of or otherwise injected into disposal zone 26. The perforations 32 and 34 may be formed by conventional or other suitable techniques. In another embodiment, the production tubing may have an open bottom in place of or in addition to perforations.

A production tubing 40 extends in the wellbore 20 from a surface wellhead 42 to the production zone 24. An annulus 46 formed between the casing 30 and the production tubing 40 is sealed off by packers 44 at or near the upper and lower boundaries of the disposal zone 26. The packers 44 may be conventional production or other suitable packers positioned to isolate in the annulus 46 at production zone 24 from the annulus 46 at the disposal zone 26. The production tubing 40 includes perforations 48 to allow formation fluids 36 to enter into the interior of the tubing 40. The production tubing 40 defines, in the illustrated embodiment, a production flowpath 50 from the production zone 24 to the wellhead 42. Formation fluids 36 may otherwise enter into the production tubing 40.

The production tubing 40 includes a downhole oil and water separator 52 at, in one embodiment, the level of the disposal zone 26. The oil and water separator 52 may be otherwise suitably positioned in the flowpath 50. For example, the oil and water separator 52 may be disposed adjacent to the production zone 24. The downhole oil and water separator 52 is operable to separate at least some water 38 from oil in the production flowpath 50. The separated water 38 may include a minority oil phase. Thus, the downhole oil and water separator 52 may partially separate, substantially separate or completely separate the oil and water in the production flowpath 50. As used herein, water 38 may include water as well as associated by-products in the formation fluid 50. Oil may be any suitable hydrocarbon or other petroleum product.

The downhole oil and water separator 52 includes a filter element 54. In one embodiment, the filter element 54 may have a height substantially equal to the height of the disposal zone 26. In other embodiments, the filter element 54 may have a height greater than, substantially greater than, less than, or substantially less than that of the disposal zone 26. The filter element 54 may be cylindrically shaped and in direct fluid communication with the disposal zone 26 via annulus 46.

The filter element 54 comprises a water-selective membrane. The water-selective membrane may be a hydrophilic membrane or other material that has a strong affinity for water. Such materials may be sized to pass smaller water molecules while blocking larger hydrocarbons. Other materials may include expanded polytetra-fluoro-ethylene (EPTFE) and non-expanded PTFE.

One or more chokes 60 may be provided in the production tubing 40 to control differential pressure in the production tubing 40 between the levels of the production zone 24 and the disposal zone 26 and/or between the production tubing 40 and the disposal zone 26. Thus, for example, formation fluids 36 in the production tubing 40 at the level of the disposal zone 26 may have a pressure that is 3 to 5 pounds per square inch (psi) higher than that of the disposal zone 26 to ensure the flow of water 38 is into the disposal zone 26. The differential pressure may be suitably varied. In some embodiments, the chokes 60 may be omitted. The choke may be any suitable pressure regulation or control system.

In operation, formation fluids 36 including oil and water enter into the production flowpath 50 via perforations 32 and 48 in the casing 30 and production tubing 40, respectively. As previously discussed, formation fluids 36 may enter the production flow path 50 via an open bottom or otherwise. Formation fluids 36 flow up the production tubing 40 to the wellhead 42 based on reservoir pressure. In a particular embodiment, a submersible or other pump may be used for lift. As the production fluids 36 are conveyed through the downhole oil and water separator 52, water 38 is removed via the water-selective membrane of the filter element 54 to form separate water and oil streams. The water stream may have a minority oil phase and/or be substantially or completely water. Similarly, the oil stream may have a minority water phase and/or be substantially or completely oil. The water stream 38 is conveyed through perforations 34 in the production casing 30 or other suitable openings to the disposal zone 26. Accordingly, the concentration of oil in the formation fluids 36 reaching the wellhead 42 is higher than that originally received from the production zone 24.

Figure 2A:
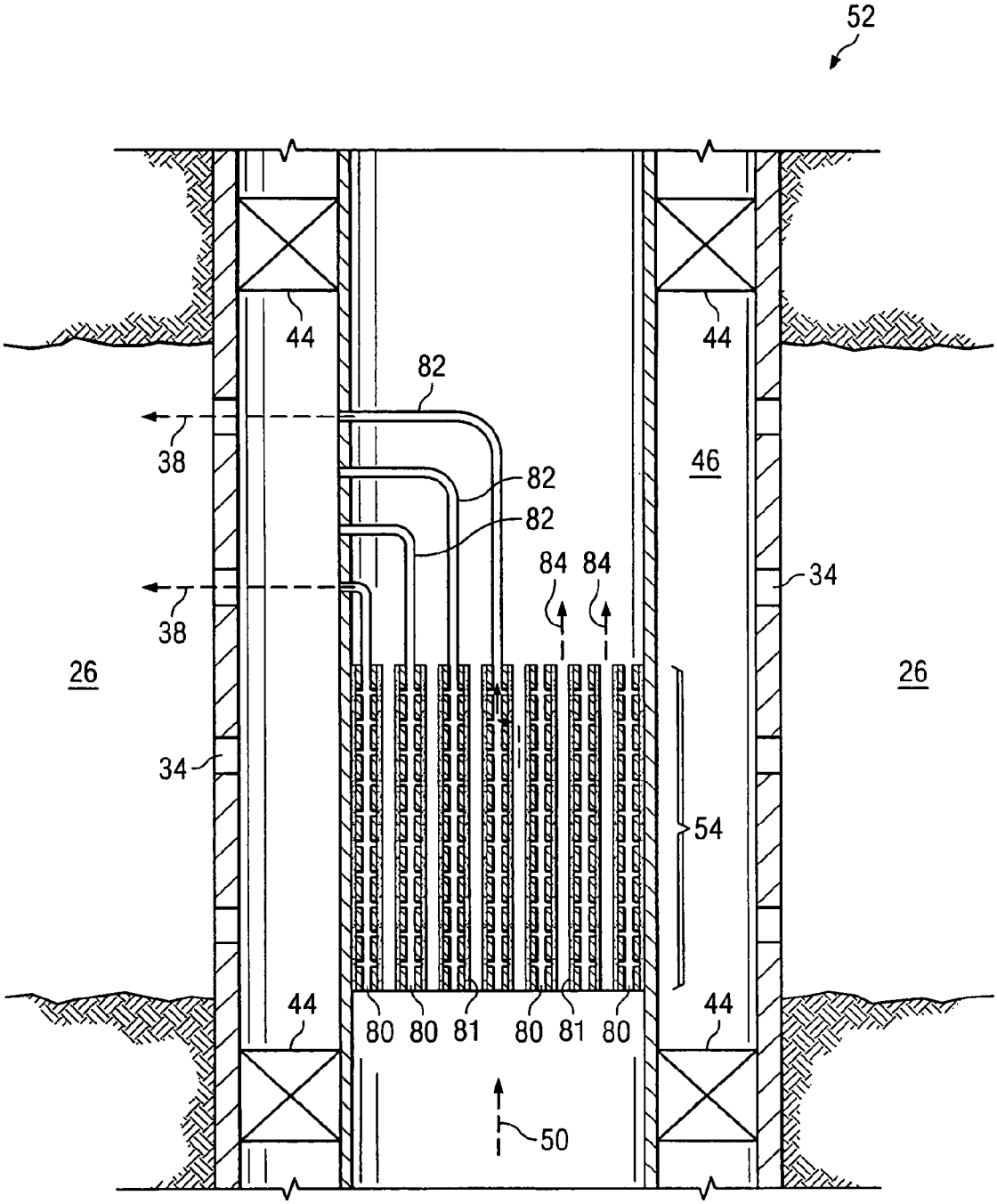
FIGS. 2A-2B illustrate additional embodiments of the oil and water separator of FIG 1.
Figure 2B:
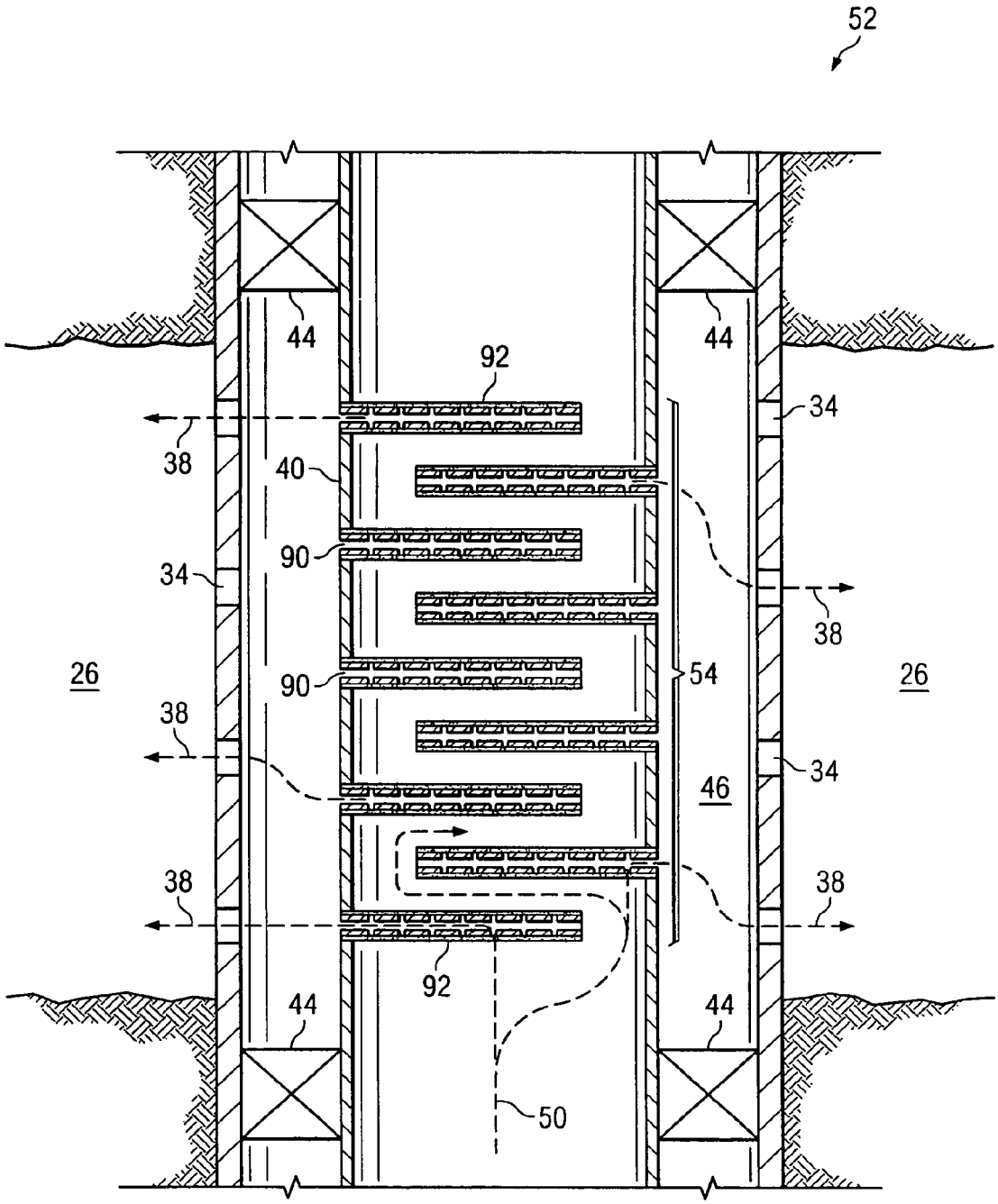

FIGS. 2A-B illustrate additional embodiments of the oil and water separator 52. In these embodiments, the filter element 54 comprises a plurality of perforated collector tubes with the water-selective membrane covering the perforations. The collector tubes may be any suitable piping or channel operable to convey water 38 to the disposal zone 26. Water 38 is conveyed to the disposal zone 26 when it is carried to or toward the zone 26. The perforations may be any openings suitable to receive water 38 from the production flowpath 50. The membrane may be disposed outwardly or inwardly of the collector tubes, or otherwise to selectively pass water 38 from the formation fluid 36 into and/or along the collector tubes. In particular, FIG. 2A illustrates a concentric arrangement of collector tubes. FIG. 2B illustrates a lateral arrangement of collector tubes.

Referring to FIG. 2A, the downhole oil and water separator 52 in this embodiment includes a concentric arrangement of perforated collector tubes 80 in the filter element 54. Each collector tube 80 is concentric to the others and, in the illustrated embodiment, covered with the water-selective membrane 81. As described above, the water-selective membrane 81 may be disposed outwardly or inwardly of each collector tube 80. Each collector tube 80 communicates collected water 38 to the disposal zone 26 through one or more tubes 82 extending from the collector tube 80 to the perforation of the production tubing 40.

The collector tubes 80 form a series of concentric annular flowpaths 84 through the downhole oil and water separator 52. The annular flowpaths 84 provide an increased surface contact area between the formation fluids 36 flowing in the production flowpaths 50 and the water-selective membrane 81 of the filter element 54. Accordingly, a greater amount of water 38 may be removed from the production flowpath 50 to minimize water produced at the surface that must be reinjected.

Referring to FIG. 2B, the downhole oil and water separator 52 in this embodiment includes the plurality of perforated collector tubes 90 disposed laterally in the production tubing 40 to create a serpentine flowpath 50 at the level of the disposal zone 26. In this embodiment, each collector tube 90 is covered with the water-selective membrane 92. Water 38 collected by the collector tube 90 is conveyed into the annulus 46 between packers 44 and through perforations 34 to the disposal zone 26.

The serpentine flowpath 50 increases the surface area of the filter element 54 exposed to the production flowpath 50 and enhances water separation from formation fluids 36 produced to the wellhead 42. In this embodiment, the filter element 54 may have tens, hundreds or more collector tubes 90 each extending two-thirds or more of the way across the diameter of the production tubing 40 and spaced within a diameter of each other. In a particular embodiment, the tube of this or other embodiments may be spaced such that fluid disturbances created by vortex shedding interact with neighboring tubes. Also, in this embodiment, the collection tubes 90 may have a width extending from one side to the other side of the production tubing 40. In other embodiments, a plurality of round, oval or other suitable collector tubes 90 may be disposed at each level. Collector tubes 90 may be otherwise suitably configured and/or disposed in the production flowpath 50 for separating water 38 from formation fluids 36.

Figure 3:
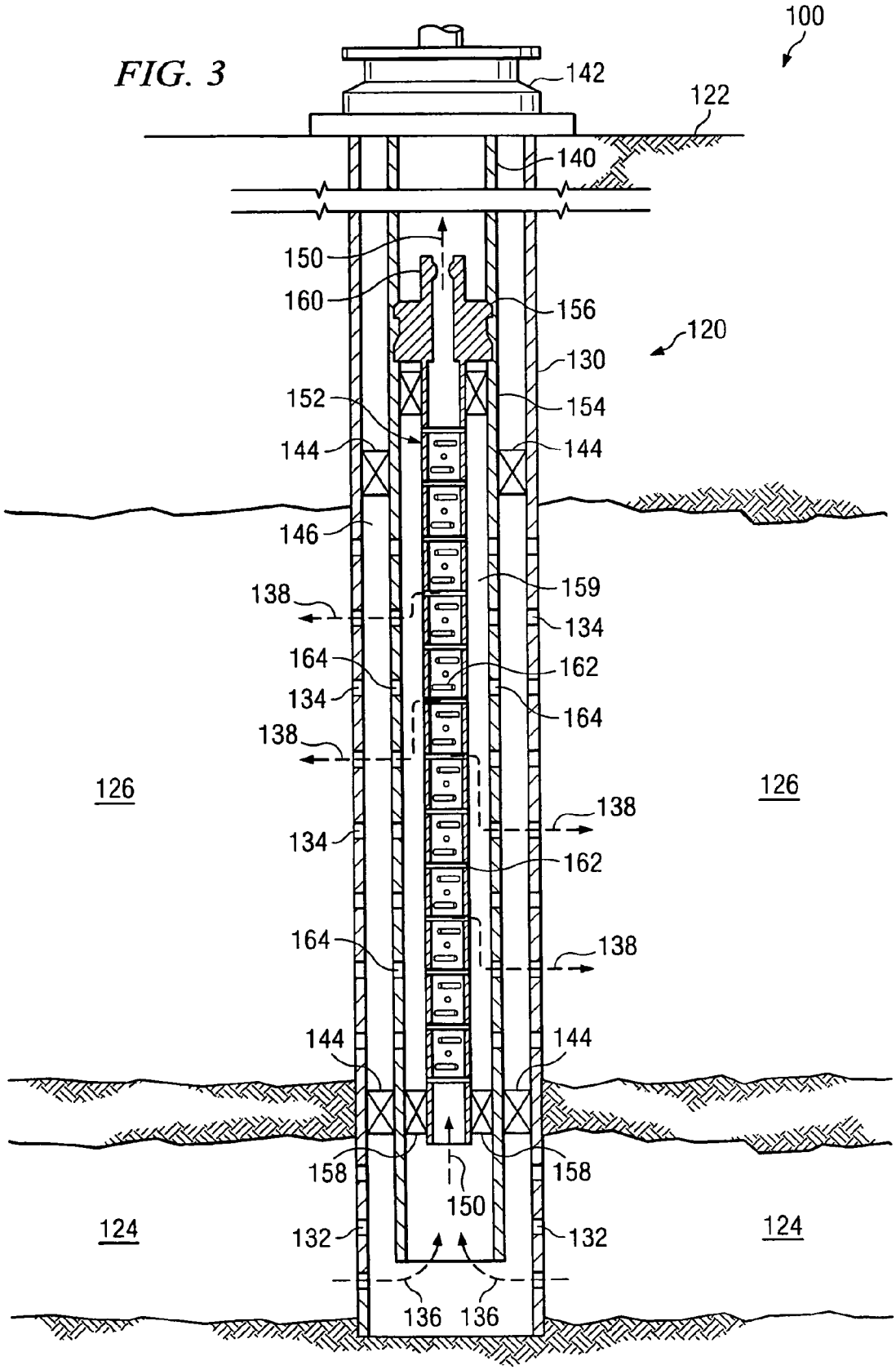
FIG. 3 illustrates another embodiment of an oil well with a downhole oil and water separator.

FIG. 3 illustrates another embodiment of an oil well 100 with a downhole oil and water separator. In this embodiment, the downhole oil and water separator is removable for easy replacement when the water-selection membrane is clogged. The oil and water separator 52 and/or filter element 54 of FIGS. 1 and 2A-B may be similarly removable.

Referring to FIG. 3, and as described in connection with oil well 10, oil well 100 may have a wellbore 120 extending from a surface 122 to a production zone 124. A disposal zone 126 may be disposed between the surface 122 and the production zone 124. A casing 130 may include perforations 132 at the production zone 124 and 134 at the disposal zone 126. Production tubing 140 may extend from a wellhead 142 to the production zone 124 and define a production flowpath 150.

Packers 144 may seal an annulus 146 between the casing 130 and the production tubing 140 at the upper and lower boundaries of the disposal zone 126.

The downhole oil and water separator 152 is retrievably disposed in the production tubing 140. In one embodiment, the production tubing 140 includes a landing nipple with a lock mandrel connector 156 to allow the downhole oil and water separator 152 to be periodically removed and replaced. In this embodiment, a set of seals 158 may be disposed between the filter element 154 and the production casing 140. A choke 160 may be disposed at the top of the oil and water separator 152 to maintain a differential pressure between formation fluids 136 in the filter element 154 and the water or other fluid in the disposal zone 126.

The filter element 154 comprises a filter stack including criss-crossing collector tubes 162. The collector tubes 162 may each be perforated and extended laterally across the filter element 154. The collector tubes 162 may be covered internally, externally or otherwise with the water-selective membrane to filter out water 138 from formation fluids 136 flowing through the filter element 154.

In operation, formation fluids 136 flow at pressure from the production zone 124 through perforations 132 and into the production tubing 140. As the formation fluids 136 travel through the filter element 154, water 138 is separated out through the water-selective membrane and communicated by the collector tubes 162 through perforations 164 in the production tubing 140 and perforations 134 in the casing 130 to disposal zone 126. At the outlet of the filter element 154, the formation fluids 136 include a higher concentration of oil than the fluids received from the production zone 124. In a particular embodiment, all, substantially all, or the majority of the water 138 may be removed from the formation fluids 136 by action of the downhole oil and water separator 152. In another embodiment, a majority, but a reduced amount of the formation fluids 136 may comprise water after filtering.

Although not illustrated in FIG. 3, a downhole pump may be used at the level of the production zone 124 or elsewhere to increase pressure in the production flowpath 150 in the production tubing 140. The pump may be a submersible pump or a progressive cavity pump. For example, for a submersible pump, a power cable may be run to the pump through the packer in the permanent annulus 146.

A pump may be used to control the flow rate of fluid in the downhole oil and water separator to continually clean the membrane. For example, at flow rate of 10-30 feet per second, oil and solids that otherwise accumulate may be scraped off, eroded or otherwise removed from the membrane to leave it exposed. In another embodiment, a pump may be used to inject separated water 138 into the disposal zone 126. For example, in an embodiment in which the disposal zone 126 is located below the level of the producing zone 124, the downhole oil and water separator 152 may be positioned at the level of the production zone 124 and separated water 138 may flow by gravity downward to a pump coupled to an end of the oil and water separator 152. The pump may force or otherwise inject the water 138 into the disposal zone 126. As previously described, a mechanical pump may be completely omitted and flow otherwise controlled.

Figure 4A:
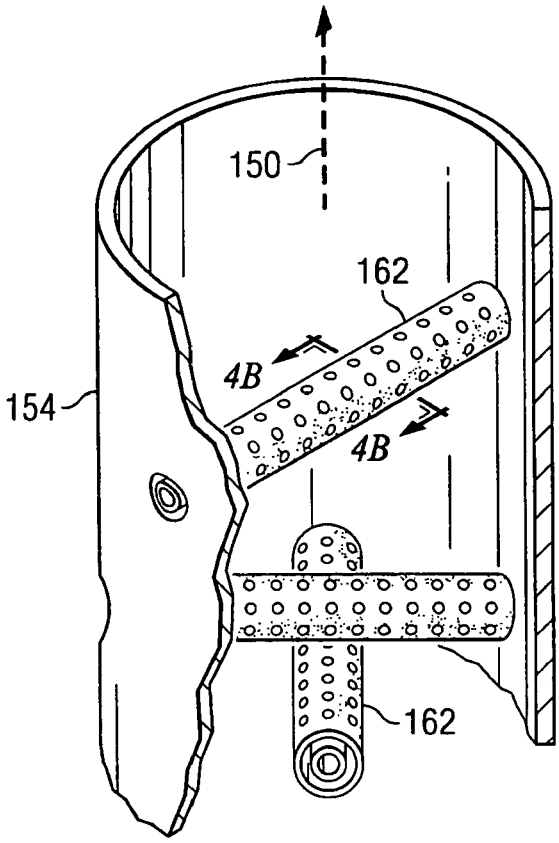
FIGS. 4A-4B illustrate details of the oil and water separator of FIG. 3.
Figure 4B:
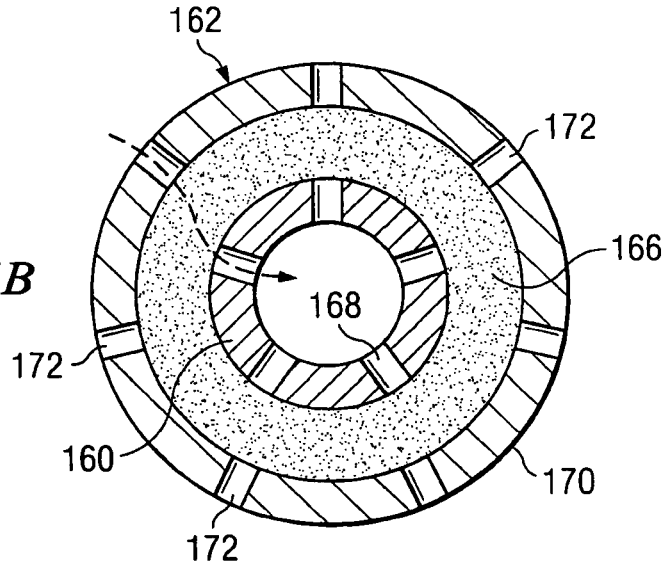

FIGS. 4A-B illustrate details of one embodiment of the filter stack of FIG. 3. In particular, FIG. 4A illustrates criss-crossing collector tubes 162 of the filter element 152. FIG. 4B illustrates a cross section of the collector tubes 162 along line 4B in FIG. 4A.

Referring to FIG. 4A, perforated collector tubes 162 extend across the filter element 154 and criss-cross one another in the flowpath 150 to increase the surface area of the filter element 152 for filtering water 138. The collector tubes 162 may be round, oval or may have an enlarged cross section perpendicular to the production flowpath 150 to maximize fluid flow over the tubes 162. Filtered water 138 exits each end of the collector tubes 162 into the inner annulus 159 between the filter element 154 and the production tubing 140 and passes through perforations 164 in the production tubing 140 and similar perforations 134 in the casing into disposal zone 126. The collector tubes 162 may be otherwise suitably disposed in the production flowpath 150. In addition, several collector tubes 162 may be disposed in the filter element 154 at each level.

Referring to FIG. 4B, the perforated collector tubes 162 may each be covered inwardly, outwardly or otherwise with the water-selective membrane 166. In the illustrated embodiment, the water-selective membrane 166 covers an outer periphery of the collector tube 162. The water-selective membrane 166 passes water from the formation fluids 136 through perforations 168 into an interior of the collector tube 162. A wire mesh or other suitable perforated material 170 with openings 172 may overlap and protect the water-selective membrane 166. The protective material 172 may be in some embodiments omitted. As previously described, the water-selective material may be any material suitable to selectively pass water over oil in a production environment.

Figure 5:
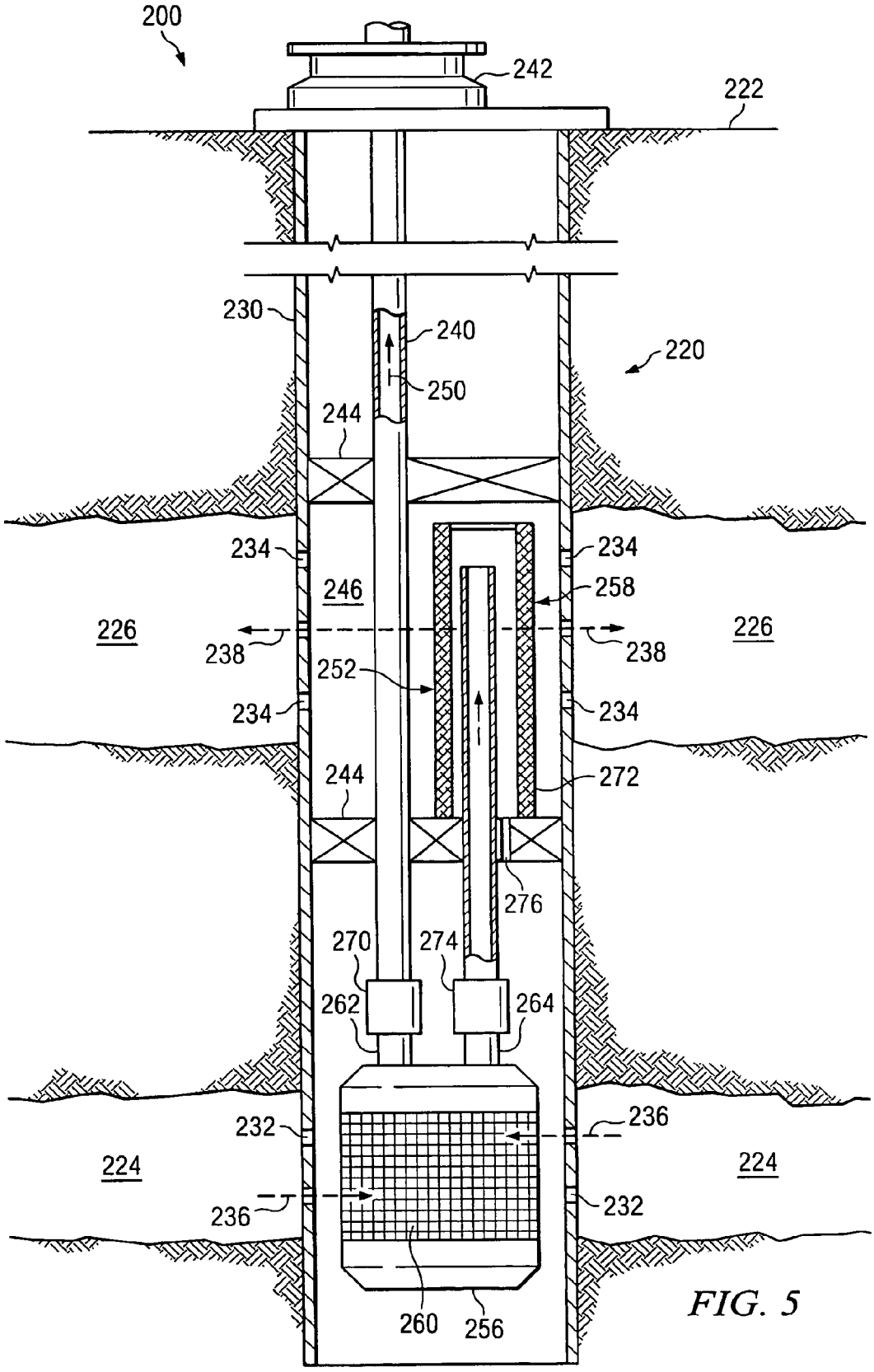
FIG. 5 illustrates still another embodiment of an oil well with a downhole oil and water separator.

FIG. 5 illustrates another embodiment of an oil well 200 with a downhole oil and water separator. In this embodiment, as described in more detail below, the oil and water separator includes a first stage separator and a second stage separator. The oil and water separator 52 of FIG. 1 and/or 152 of FIG. 3 may likewise include a multi-stage separator. In addition, the downhole oil and water separator may have more than two stages, with a water-selective membrane as the final stage.

Referring to FIG. 5, and as described in connection with oil well 10 and oil well 100, oil well 200 may have a wellbore 220 extending from a surface 222 to a production zone 224. A disposal zone 226 may be disposed between the surface 222 and the production zone 224. A casing 230 may include perforations 232 at the production zone 224 and perforations 234 at the disposal zone 226. Production tubing 240 may extend from the wellhead 242 to the production zone 224 and/or downhole oil and water separator 252 and define a production flowpath 250. Packers 244 may seal an annulus 246 between the casing 230 and the production tubing 240 at the upper and lower boundaries of the disposal zone 226.

The downhole oil and water separator 252 may be a multi-stage separator and may in one embodiment include a first stage separator 256 and a second stage separator 258. Additional stages may also be included. The first stage separator 256 may be a gravity oil and water separator at a level of the production zone 224. The first stage gravity oil and water separator may be used, for example, in wells with low overall flow rates. In other embodiments, a hydrocyclone or orbital separator may be used at the level of the production zone 224 or elsewhere. The gravity oil and water separator 256 may have an inlet 260, an oil outlet 262 and a water outlet 264. The oil outlet 262 of the gravity oil and water separator 256 may be connected to the production tubing 240 for production of the egress oil stream to the wellhead 242. A pump 270 may be disposed at the oil outlet 262 of the gravity separator 256 to assist in production of the oil stream to the surface 222.

The water outlet 264 from the gravity oil and water separator 256 may feed into the second stage separator 258. In this embodiment, the second stage separator 258 includes a filter element 272 with a water-selective membrane. A pump 274 may be disposed at the water outlet 264 to pressurize water flowing into the second stage separator 258.

In the second stage separator 258, water 238 passing through the water-selective membrane is injected into the disposal zone 226. Oil and/or water not passing through the water-selective membrane may be recirculated through a recirculation passage 276 back to the first stage separator 256. In this embodiment, the water-selective membrane in the second stage separator 258 may be used to clean-up water output from the first stage separator 256. The first stage and/or second stage separators 256 and 258 may be configured in any suitable manner. For example, the disposal zone 226 could, as previously described, be below the level of the production zone 224. In any event, the water-side outlet of the first stage separator 256 is circulated past the water-selective membrane, which allows water to pass, and re-circulates the remaining oil-enriched water through the first stage separator 256. The use of the first and second stage separators 256 and 258 may reduce the amount of water produced to the surface 222 from the single-stage separator embodiment.

A number of embodiments of the invention have been described. Nevertheless, it will be understood that various modifications may be made without departing from the spirit and scope of the invention. For example, a sump may be formed beneath a production zone such that solid debris falling out from the filtering process will not build up and interfere with production. Accordingly, other embodiments are within the scope of the following claims.

What is claimed is:

1. A well, comprising:

a well tool comprising:

a first stage separator disposed in a production zone of a production flowpath of the well and operable to pass, from the production flow path, water preferably over oil to an outlet thereof;

a second stage separator having an inlet coupled to the outlet of the first stage separator that receives flow passed by the first stage separator and having a filter element comprising a water-selective membrane disposed in the production flowpath of the well at a level of a disposal zone, the filter element operable to pass, from the production flowpath, water preferably over oil, into the disposal zone; and a recirculation passage between the first stage separator and the second stage separator that communicates flow not passed by the second stage separator into the disposal zone back to a location above a downhole end of the first stage separator, the second stage separator disposed in the disposal zone of the production flowpath hydraulically isolated from the production zone.

2. The well of claim 1, wherein the filter element is operable to increase a concentration of oil in the production flowpath above the disposal zone.

3. The well of claim 1, wherein the filter element comprises comprising a plurality of concentric perforated collector tubes with the water-selective membrane covering the perforations.

4. The well of claim 1, wherein the filter element comprises a plurality of perforated collector tubes with the water-selective membrane covering the perforations.

5. The well of claim 1, wherein the filter element comprises a plurality of overlapping perforated collector tubes with the water-selective membrane covering the perforations.

6. The well of claim 1, wherein water separated from the oil is communicated to the disposal zone without mechanical pumping of the water.

7. The well of claim 1, wherein fluid in the production flow path flows at a velocity calculated to clean oil and solids off of the filter element.

8. The well of claim 1, further comprising a conduit coupled to the outlet of the first stage separator and the second stage separator.

9. A downhole oil and water separator, comprising:

a plurality of perforated collector tubes each disposed laterally in a production flowpath, each of the collector tubes comprising a fluid outlet disposed through a lateral exterior surface of the separator and allowing fluid communication through the lateral exterior surface of the separator;

a water-selective membrane covering perforations of the collector tubes;

the water-selective membrane operable to selectively pass water from the production flowpath laterally out of the separator into an annulus exterior to the separator circumjacent the collector tubes to a disposal zone, wherein the water-selective membrane is operable to selectively pass water from the production flowpath into an interior of the perforated collector tubes, and wherein the concentration of oil in the production flowpath is increased.

10. The separator of claim 9, further comprising the perforated collector tubes forming a serpentine flowpath.

11. The separator of claim 9, wherein the water-selective membrane covers an exterior of the perforated collector tubes.

12. The separator of claim 9, wherein the plurality of perforated collector tubes are disposed only laterally in the production flowpath.

13. The separator of claim 9, wherein the fluid outlet comprises an extension tube allowing fluid communication from the collector tube through the lateral exterior surface of the separator.

14. A well, comprising:

a production zone producing oil and water;

a disposal zone hydraulically isolated from the production zone;

a production flowpath extending from the production zone to the disposal zone and to the well surface;

a downhole oil and water separator system disposed in the production flowpath, the separator system including:

a first stage separator with an outlet coupled to an inlet of a second stage separator, the first and second stage separators operable to separate oil and water in the production flowpath, at least one of the first and second stage separators comprising a water-selective membrane operable to selectively pass water in the production flowpath to the disposal zone, wherein one of the first or second stage separators is disposed in the production flow path in the production zone and the other of the first or second stage separators is disposed in the production flowpath in the disposal zone; and a recirculation passage extending between the first stage separator and the second stage separator, the recirculation passage operable to recirculate at least a portion of at least one of the oil or the water not passing through the water-selective membrane from the second stage separator to a location above a downhole end of the first stage separator.

15. The well of claim 14, wherein the first stage separator is an oil and water gravity separator, the oil and water gravity separator operable to separate formation fluids in the production flowpath into an oil stream comprising a higher concentration of oil than the formation fluid and a water stream comprising a higher concentration of water than the formation fluid.

16. The well of claim 15, the second stage separator comprising a plurality of perforated collector tubes with the water-selectable membrane covering the perforations, the second stage separator operable to receive the water stream and to convey water passing through the water-selective membrane to the disposal zone.

17. The well of claim 16, wherein the collector tubes are concentric.

18. The well of claim 16, wherein the collector tubes are disposed laterally in the production flowpath.

19. The system of claim 16, further comprising a downhole pump operable to pump the water stream between the first and second stage separators.

20. The well of claim 14, wherein the first stage separate is an oil and water hydrocyclone separator, the oil and water hydrocyclone separator operable to separate formation fluids in the production flowpath into an oil stream comprising a higher concentration of oil than the formation fluid and a water stream comprising a higher concentration of water than the formation fluid.

21. The well of claim 14, wherein the first stage separator is an oil and water orbital separator, the oil and water orbital separator operable to separate formation fluids in the production flowpath into an oil stream comprising a higher concentration of oil than the formation fluid and a water stream comprising a higher concentration of water than the formation fluid.

22. The well of claim 14, further comprising a conduit coupled to the outlet of the first stage separator and the second stage separator.

23. A method for separating oil and water downhole in a well comprising:

providing downhole in the well an oil and water separator system including a first stage separator and a second stage separator comprising a water-selective membrane;

providing the first stage separator in a first zone of a production flowpath;

providing the second stage separator in a second zone of the production flowpath hydraulically isolated from the first zone;

filtering with the first stage separator formation fluid in the production flowpath into a first oil stream comprising a higher concentration of oil than the formation fluid and a first water stream comprising a higher concentration of water than the formation fluid;

filtering the water stream with the second stage separator into a second oil stream comprising a higher concentration of oil than the formation fluid and a second water stream comprising a higher concentration of water than the first water stream;

recirculating the second oil stream from the second stage separator to a location above a downhole end of the first stage separator;

filtering the second oil stream in the first stage separator; and producing the first oil stream to the surface.

24. The method of claim 23, further comprising injecting the second water stream into a disposal zone in the well.

25. The method of claim 24, further comprising maintaining a pressure differential between the production flowpath and the disposal zone.

26. The method of claim 23, wherein the oil and water separator system further comprises a conduit coupling an outlet of the first stage separator to the second stage separator.

27. A downhole oil and water separation system, comprising:

a first stage separator disposed in a first zone of a production flowpath; and a second stage separator disposed in a second zone of the production flowpath hydraulically isolated from the first zone, the second stage separator operable to return flow not passed into the second zone by the second stage separator to a location above a downhole end of the first stage separator, wherein at least one of the first and second stage separators comprise:

a plurality of perforated collector tubes each disposed laterally in the production flowpath; and a water-selective membrane covering perforations of the collector tubes and operable to selectively pass water from the production flowpath laterally out of the particular separator into an annulus exterior to the particular separator circumjacent the collector tubes to a disposal zone, the water-selective membrane operable to selectively pass water from the production flowpath into an interior of the perforated collector tubes, wherein the concentration of oil in the production flowpath is increased.

28. The system of claim 27, wherein the plurality of perforated collector tubes are disposed only laterally in the production flowpath.

29. The system of claim 27, wherein each of the collector tubes comprise a fluid outlet disposed through a lateral exterior surface of the separator and allowing fluid communication through the lateral exterior surface of the separator.

30. The system of claim 29, wherein the fluid outlet comprises an extension tube allowing fluid communication from the collector tube through the lateral exterior surface of the separator.

* * * * *